US007210660B2

(12) United States Patent
James et al.

(10) Patent No.: US 7,210,660 B2
(45) Date of Patent: May 1, 2007

(54) PEGBOARD ADAPTER

(75) Inventors: Gary W. James, Parma Heights, OH (US); Gary R. Kish, Parma, OH (US); Bernard J. Golias, Jr., Twinsburg, OH (US)

(73) Assignee: Metal Fabricating Corporation, Cleveland, OH (US)

( * ) Notice: Subject to any disclaimer, the term of this patent is extended or adjusted under 35 U.S.C. 154(b) by 329 days.

(21) Appl. No.: 10/812,222

(22) Filed: Mar. 29, 2004

(65) Prior Publication Data

US 2004/0263034 A1 Dec. 30, 2004

Related U.S. Application Data

(60) Provisional application No. 60/458,637, filed on Mar. 28, 2003.

(51) Int. Cl.
*A47B 96/00* (2006.01)

(52) U.S. Cl. ..... 248/220.31; 312/351

(58) Field of Classification Search ..... 312/351, 312/245; 211/59.1; 248/220.31, 220.41, 248/220.42, 220.43
See application file for complete search history.

(56) References Cited

U.S. PATENT DOCUMENTS 1,822,037 A * 9/1931 Kerschner ..... 29/887
2,400,807 A * 5/1946 Burkhard ..... 248/222.12
2,594,943 A * 4/1952 Logan ..... 235/90
2,761,640 A 9/1956 Frater
D188,221 S * 6/1960 Maro ..... D6/574
3,091,423 A * 5/1963 Butterworth ..... 248/220.43
4,029,282 A 6/1977 Dauth
4,071,212 A * 1/1978 Burrows et al. ..... 248/37.6
4,258,892 A 3/1981 Craine
4,264,013 A * 4/1981 Vollmer ..... 211/85.2
4,606,466 A * 8/1986 Fredrickson ..... 211/59.1
4,776,650 A * 10/1988 Ferenzi ..... 312/245
5,407,170 A * 4/1995 Slivon et al. ..... 248/552
5,695,261 A 12/1997 Slesinger et al.
5,803,420 A * 9/1998 Conway et al. ..... 248/231.41
6,848,589 B2 * 2/2005 Wood ..... 211/189
6,926,136 B1 * 8/2005 Lynch-Bass ..... 206/6.1
2002/0180318 A1 * 12/2002 Bitner et al. ..... 312/200

* cited by examiner

*Primary Examiner*—Janet M. Wilkens
(74) *Attorney, Agent, or Firm*—Fay Sharpe LLP

(57) ABSTRACT

An adapter for selectively mounting to an associated wall of a cabinet has a first wall having a plurality of openings for receiving associated peg hooks. The adapter further has a second wall depending from a first end of the first wall and a third wall extending from the second wall and including an opening for mounting the adapter to the associated wall.

3 Claims, 3 Drawing Sheets

PEGBOARD ADAPTER

This application claims the benefit of U.S. Provisional Application No. 60/458,637, filed Mar. 28, 2003, which is incorporated by reference.

BACKGROUND OF THE INVENTION

This invention relates to an assembly that can be used for supporting objects on a cabinet wall. More particularly, this invention is directed to an apparatus that can mount to lances or support members on a wall of a metal cabinet which are typically used for mounting removable shelves to the cabinet. A pegboard adapter can mount to the lances so that a cabinet which previously only had shelves can now have the advantages of having a pegboard for receiving peg hooks.

Metal cabinets are some of the most versatile pieces of furniture available. Metal cabinets can be hung in work areas, e.g., metal or woodworking shops, garages, as well as many other places. Metal cabinets can also provide storage in vehicles such as trucks and vans. In addition to the versatility provided by metal cabinets regarding the location and placement of the cabinets, metal cabinets also provide versatility in what they store. Metal cabinets have been used to store threaded rod, wire, brake line, welding rods, as well as more common items such as tools and fasteners. To increase a metal cabinet's versatility, some of the shelves are removable so that larger or different items can be stored in the cabinet. The removable shelves are typically mounted on lances that are fastened to or punched out of a cabinet side wall.

SUMMARY OF THE INVENTION

An adapter which is selectively mountable to an associated wall of a cabinet includes a first wall having a plurality of openings for receiving associated peg hooks. The adapter further includes a second wall depending from a first end of the first wall and a third wall extending from the second wall and including an opening for mounting the adapter to the associated wall. The third wall is substantially parallel to the first wall.

A method for providing a removable peg board in a cabinet having a plurality of lances on a side wall of the cabinet includes providing a peg board adapter and mounting the peg board adapter to a wall of the cabinet. The peg board adapter includes a first wall having a plurality of openings for receiving peg hooks, a second wall depending from the first wall, and a third wall extending from the second wall such that the third wall is at least substantially parallel to the first wall. The third wall includes a mounting opening. The peg board is mounted to the cabinet by placing one of the lances through the mounting opening and supporting a portion of the third wall on the lance.

Still other aspects of the invention will become apparent to those skilled in the art upon reading and understanding the following detailed description.

BRIEF DESCRIPTION OF THE DRAWINGS

The invention may take physical form in certain parts and arrangements of parts, one embodiment of which will be described in detail in this specification and illustrated in the accompanying drawings that form a part hereof and wherein.

DETAILED DESCRIPTION OF THE EMBODIMENT

Figure 1:
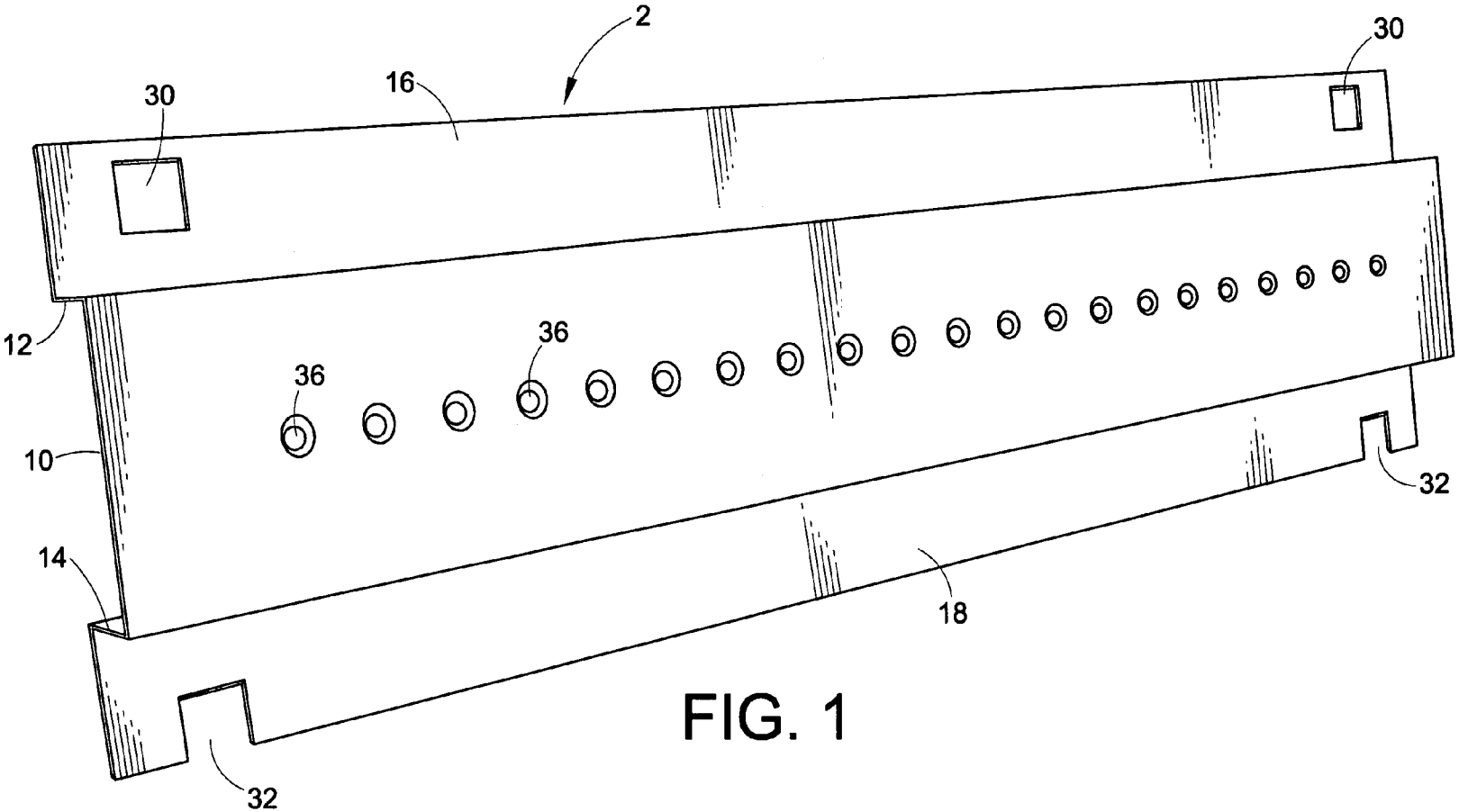
FIG. 1 is a perspective view of a pegboard adapter in accordance with an embodiment of the present invention.
Figure 2:
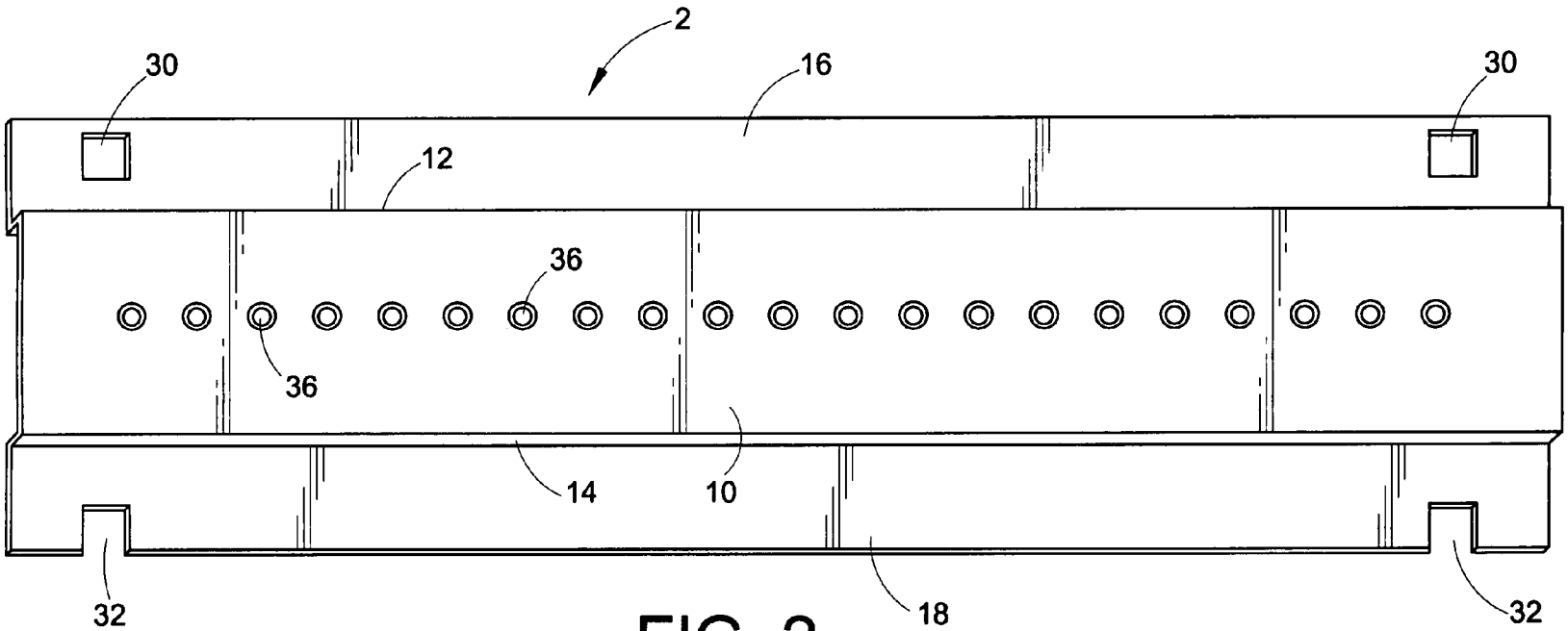
FIG. 2 is a front elevational view of the pegboard adapter of FIG. 1.

Referring now to the drawings, wherein the showings are for purposes of illustrating a preferred embodiment of the invention only and not for purposes of limiting same, FIGS. 1–4 illustrate a pegboard adapter 2 which is mountable to a cabinet wall. The pegboard adapter in the present application is made of a metal, preferably steel; however, the pegboard adapter could also be made of other suitable materials, such as plastic.

Specifically, the pegboard adapter 2 has a main wall 10 having first and second lateral side walls 12 and 14 which depend from and are substantially perpendicular to the main wall. Walls 12 and 14 are substantially parallel to each other. The pegboard adapter also includes a first flange 16 extending from and substantially perpendicular to the first wall 12. A second flange 18 extends substantially perpendicular to and from the second wall 14. The main wall 10 is spaced from and is parallel to the flanges 16 and 18. Preferably, flanges 16 and 18 are positioned in the same plane.

Flanges 16, 18 include openings 30, 32, respectively, for receiving a lance B (see FIG. 4) mounted to or punched out of a cabinet wall. Openings 30, 32 are used to mount the pegboard adapter 2 to the cabinet. Openings 32 can be formed as slots which can be slid over lances adjacent a bottom wall of the cabinet. The slots assist in placement of the adapter over lances adjacent a bottom wall of the cabinet and allow the lower edge of flange 18 to abut or rest against the bottom wall of the cabinet. The specific number and placement of openings 30 or slots 32 is dependent upon the spacing and number of lances in the side wall of the cabinet.

Main wall 10 includes a plurality of openings 36 adapted to receive hooks or hangers. The size and shape of the openings 36 are such that the openings can receive standard pegs, hooks or hangers that can fit into a conventional pegboard. Furthermore, the amount of openings as well as the number of columns or rows can be determined to meet the needs of the user of the cabinet according to the number and types of items that will be hung from the peg board adapter. Referring to FIG. 1, the openings are shown to be equally spaced apart; however, the openings may also be spaced unequally along the wall without departing from the scope of the present invention. The lateral side walls 12 and 14 provide the spacing between the cabinet wall A and the main wall 10. The lateral side walls 12 and 14 are shown as perpendicular to the main wall 10; however, the side walls 12 and 14 can be at any angle so long as adequate space is provided between the main wall 10 and the cabinet rear A.

Figure 4:
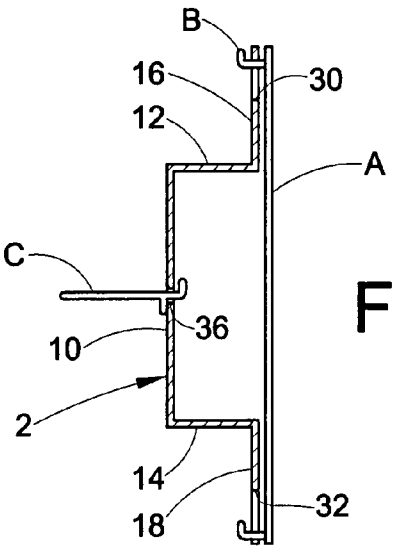
FIG. 4 is a side cross-sectional view of the pegboard adapter of FIG. 1 mounted to a sidewall of a cabinet.

As best seen in FIG. 4, the pegboard adapter 2 mounts on a cabinet wall A such that lances B protrude through openings 30 and slots 32. The main wall 10 is adequately spaced from the cabinet wall A so that a hook or hanger C can protrude through one of the hook openings 36 and mount to the pegboard adapter 2 without contacting the cabinet rear wall A.

Figure 3:
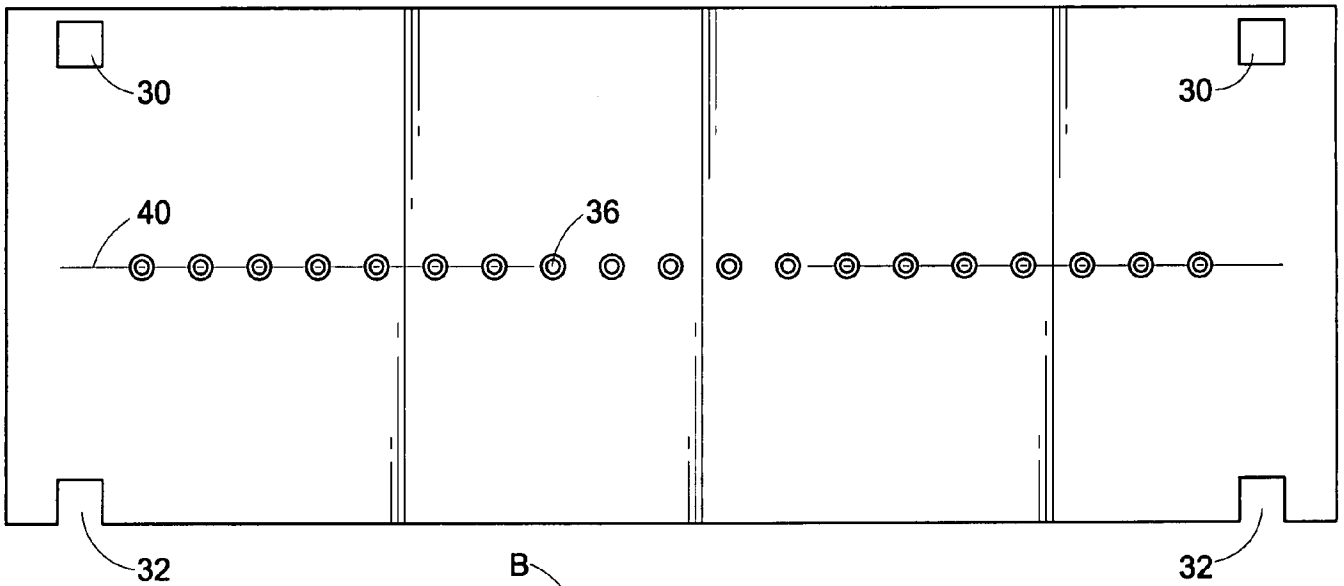
FIG. 3 is a front elevation view of the pegboard adapter of FIG. 1, prior to final metal forming.

As can be seen in FIG. 3, the pegboard adapter 2 can be manufactured and formed from a single sheet of metal. The metal can be formed so that openings 30 and slots 32 are punched or otherwise formed in the adapter. In the preferred embodiment, the holes 30 and the slots 32 are proximal the ends of the adapter. Holes 36 are formed along a central longitudinal axis 40 of the adapter 2. Walls 12 and 14 may be formed by punching or pressing a metal blank such that the walls 12, 14 are substantially perpendicular to wall 10. The walls are used to position the main wall 10 to be adequately spaced from the cabinet wall A to allow a peghook to protrude through the adapter without contacting the cabinet wall.

The invention has been described with reference to a preferred embodiment. Obviously, modifications and alterations will occur to others upon a reading and understanding of this specification. For example, the openings 36 need not be aligned along a central longitudinal axis, they could be oriented in various positions on the main wall 10. Also, the slots 32 may not be formed in the flange 18, especially if the flange 18 will rest on a shelf in the cabinet. This specification is intended to include all such obvious modifications and alterations.

The invention claimed is:

1. An adapter for selectively mounting to an associated wall of a cabinet, comprising:

a first wall having a plurality of generally circular openings configured for receiving associated peg hooks, the openings running generally along a longitudinal axis of said first wall, the first wall including first and second ends that are each generally parallel to the longitudinal axis;

a second wall depending substantially normal from the first end of the first wall;

a third wall extending from the second wall and including an opening including a linear edge for mounting the adapter to the associated wall, wherein the third wall is substantially parallel to the first wall;

a fourth wall depending substantially normal from a second end of the first wall opposite said first end of said first wall substantially parallel to the second wall; and a fifth wall extending from the fourth wall, wherein the fifth wall is substantially parallel to the first wall, wherein the fifth wall comprises a notch for mounting the adapter to the associated wall, wherein a longitudinal axis of the notch is aligned with a longitudinal axis of the opening in the third wall;

wherein said adapter is formed of a single piece construction.

2. The adapter of claim 1, further comprising a depression around each of the openings in the first wall, wherein the first wall is depressed towards the third wall.

3. The adapter of claim 1, wherein said openings in said first wall are equally spaced apart, parallel to each other, and equidistant from a top and bottom edge of the first wall.

* * * * *